US007033094B2

(12) United States Patent
Imai

(10) Patent No.: US 7,033,094 B2
(45) Date of Patent: Apr. 25, 2006

(54) PAPER CUTTER AND THERMAL PRINTER

(75) Inventor: Saburo Imai, Chiba (JP)

(73) Assignee: Seiko Instruments Inc., Chiba (JP)

( * ) Notice: Subject to any disclaimer, the term of this patent is extended or adjusted under 35 U.S.C. 154(b) by 118 days.

(21) Appl. No.: 10/367,128

(22) Filed: Feb. 14, 2003

(65) Prior Publication Data

US 2003/0172792 A1 Sep. 18, 2003

(30) Foreign Application Priority Data

Mar. 7, 2002 (JP) ..... 2002-062144

(51) Int. Cl.
*B41J 11/26* (2006.01)

(52) U.S. Cl. ..... 400/621; 83/614

(58) Field of Classification Search ..... 400/593, 400/621, 691

See application file for complete search history.

(56) References Cited

U.S. PATENT DOCUMENTS 5,441,189 A * 8/1995 Formon et al. ..... 225/2
5,531,530 A 7/1996 Kuramoto et al. ..... 400/593
6,102,596 A * 8/2000 Komori et al. ..... 400/621
6,162,159 A * 12/2000 Martini et al. ..... 493/324
6,652,173 B1 * 11/2003 Martini et al. ..... 400/621

FOREIGN PATENT DOCUMENTS

| | | |
|---|---|---|
| EP | 1044819 | 10/2000 |
| JP | 10337920 | 12/1998 |
| JP | 00000794 | 1/2000 |

* cited by examiner

*Primary Examiner*—Daniel J. Colilla
*Assistant Examiner*—Marissa Ferguson
(74) *Attorney, Agent, or Firm*—Adams & Wilks

(57) ABSTRACT

A paper cutter has a guide for guiding paper from a source of continuous paper in a forward feeding direction. A cutting tool disposed downstream of the guide partially cuts the continuous paper passing through the guide such that one portion of the paper remains uncut. Two or more projections extend inwardly into the guide and contact opposite surfaces of the continuous paper to impart thereto a resistance against forward feeding movement in response to a tensile force exerted on the continuous paper that has already passed through the guide so that the uncut portion of the continuous paper can be easily torn by the exerted tensile force. The projections are preferably inclined upwardly in the forward feeding direction to facilitate passage of the paper through the guide.

14 Claims, 4 Drawing Sheets

PAPER CUTTER AND THERMAL PRINTER

BACKGROUND OF THE INVENTION

1. Field of the Invention

The present invention relates to a cutter for cutting continuous paper with one portion thereof uncut and a thermal printer having the above cutter.

2. Description of the Related Art

There is known a paper cuter for cutting a roll of continuous paper having been printed on with one portion left uncut. Such devices have been installed in, for example, an order input device and the like for printing out menu items ordered by a customer in a fast food restaurant, a family restaurant, and the like. Hereafter, this type of cut is referred to as a partial cut.

The partial cut is used for various purposes, such as for preventing full cut paper from falling down into the device from the outlet, or for aligning several sheets of paper with the contents of orders printed in a sequence of orders while being connected by one portion, by supplying the paper without tearing off the uncut portion according to the partial cut when receiving the orders sequentially, and the like.

Generally, the paper appearing from the outlet after a partial cut is divided into individual sheets by a user's pulling the paper and tearing off the uncut portion. In case of a partial cut in which an uncut portion of the paper is left on the right side, when a user pulls the paper, holding the left side of the paper, the cut portion of the paper is opened and a force concentrates on the root, thereby making it easy to tear off the uncut portion.

However, when a user pulls the paper straight while holding the side of the uncut portion of the paper, even if the width of the uncut portion is small, a force is dispersed in this portion, and therefore, in some cases, the uncut portion cannot be torn off easily even if a user pulls on it forcefully. When this occurs, there is also a possibility of reeling out the connected paper from the device. When the paper is reeled out, various problems may occur, including an increase the space on the top of the paper at the next print-out operation and the possibility that the paper will be skewed swayed at a forwarding time.

Generally, a thermal printer clamps paper between a printing head and a platen for printing, and these components are provided in a prior stage of the cutter for performing the partial cut, such that the paper is being held by the pressure of the printing head and the platen while being cut. When the paper is pulled in a state of being uncut with a force stronger than this clamping force, the paper will be reeled out. Recently, however, there has been a tendency for the pressure between the printing head and the platen to become lower, and therefore, the problem of reeling out the paper by pulling the partial cut paper has become more serious.

SUMMARY OF THE INVENTION

An object of the present invention is to provide a paper cutter and a thermal printer which enables a user to tear off the paper easily and prevent reeling out of the paper from the device, even when a user pulls the partial cut paper straightly by the uncut portion.

In order to achieve the above object, the invention provides a paper cutter having a guide for guiding continuous paper and cutting means for cutting the continuous paper passing through the guide with one portion thereof left uncut, wherein the guide is provided with resistance adding means for adding a resistance to the continuous paper when a tensile force works on the continuous paper passing through the guide.

By the foregoing structure, even if the paper is pulled in a state in which it is difficult to tear, the resistance adding means can add a resistance to the paper, thereby tearing off the paper easily. This can prevent reeling out of the paper.

More specifically, the resistance adding means may be provided in a position corresponding to an uncut portion of the continuous paper left behind without being cut by the cutting means. This structure can add a resistance to the uncut portion of the paper efficiently, and by providing the above means only in a peripheral portion for passing the uncut portion, it is possible to prevent the paper from clogging (paper jam) due to obstructing the passage of the paper in the guide.

The resistance adding means may be formed by a plurality of projections for bending the continuous paper in contact with the both surfaces of the continuous paper passing through the guide. According to this structure, there is not much resistance imparted when the paper simply passes straight through the guide, and only when the paper is pulled and stretched straightly, resistance is added to the paper. Further, the above means can advantageously be formed at a low cost.

More specifically, two projections may be provided, one being provided facing one surface of the continuous paper and the other being provided facing the other surface thereof, the respective projections being formed in a shape having such an inclination that a protruding degree is small on a side of an inlet of the guide and large on a side of an outlet of the guide. According to this structure, the projections do not obstruct the passage of the paper along the guide by are formed with the optimum structure to obtain a suitable resistance when pulling of the paper occurs.

The inventive paper cutter is especially useful when adopted in a thermal printer comprising a printing device for printing by clamping continuous paper between a printing head having a plurality of heating elements for dot printing and a platen and a paper feed mechanism for feeding the continuous paper while rotating the platen, and the paper cutter for cutting the continuous paper fed from the printing device to the guide.

BRIEF DESCRIPTION OF THE DRAWINGS

For a better understanding of the present invention, reference is made of a detailed description to be read in conjunction with the accompanying drawings, in which.

DETAILED DESCRIPTION OF THE PREFERED EMBODIMENT

Hereinafter, embodiments of the present invention will be described with reference to the drawings.

Figure 1:
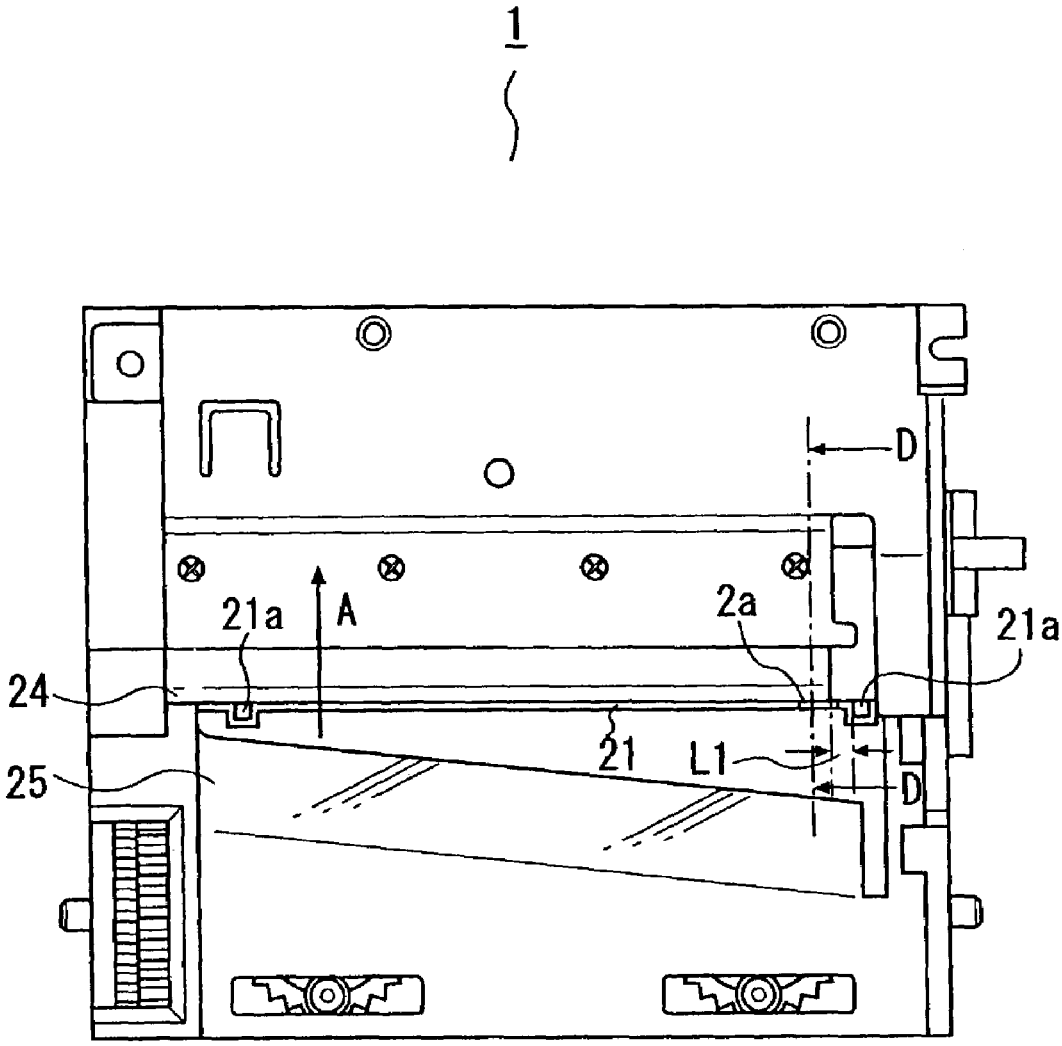
FIG. 1 is a plane view showing a thermal printer according to the embodiment of the invention.
Figure 2:
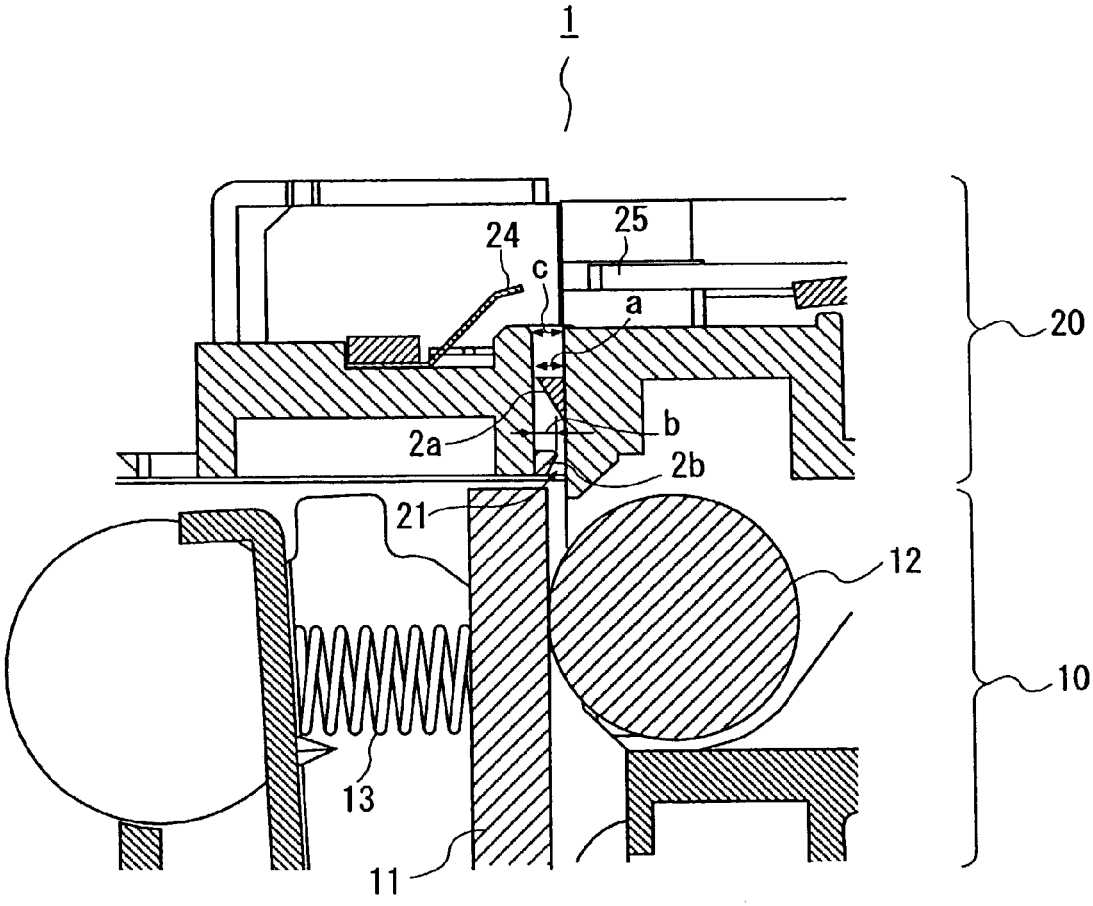
FIG. 2 is a cross section view taken along line D—D by the arrows in FIG. 1.

FIG. 1 is a plane view of a thermal printer 1 according to the embodiment of the invention and FIG. 2 is a cross section view taken along line D—D by the arrows in FIG. 1.

The thermal printer 1 of the embodiment is comprised of a printing mechanism 10 for printing on continuous paper such as roll paper, and a cutter 20 for partially cutting the continuous paper fed from the printing mechanism 10.

The printing mechanism 10 performs printing while urging the continuous paper between a printing head 11 and a platen 12, as illustrated in FIG. 2. On the printing head 11, a plurality of heating elements extending along a line are provided for dot-printing on the heat sensitive paper to perform printing for one line or several lines on the paper by one or several drives. The printing head 11 is urged toward the platen 12 by a spring 13 at a constant force. The platen 12 is formed by a member having elasticity so as to cause the paper to remain in close contact with the appropriate portion of the heating elements of the printing head 11, and by rotating the platen 12 intermittently, the paper is fed in a forward direction (upper portion in FIG. 2) thereby sequentially moving the printing position.

The cutter 20 comprises a guide 21 for introducing the paper discharged from a space between the printing head 11 and the platen 12, to a cutting position, and a fixed blade 24 and a movable blade 25 for clipping and cutting the paper passing through the guide 21. The guide 21 is designed to surround both surfaces of the paper by its two walls, which are wider than the paper, and keep into contact with the both sides of the paper by its right and left convex pieces 21*a*, 21*a* so as not to sway the paper. Further, the passage length of the guide 21 is fairly short (for example, 6 to 10 mm). Along the guide 21, two projections 2*a* and 2*b* are provided as resistance adding means for adding a resistance to the paper when the paper is pulled from the outside.

The movable blade 25 and the fixed blade 24 constitute a cutting tool and are respectively as least as long as the width of the paper or a little longer than that. The movable blade 25 moves back and forth in the direction indicated by the arrow A in FIG. 1 by the force of a driving motor and pinches the paper with the fixed blade 24 so to cut the paper. During printing, or while the platen 12 is rotating to feed the paper, the movable blade 25 is waiting at a position which is not overlapped with the outlet of the guide 21.

The fixed blade 24 is arranged so as not to overlap the right end portion of the paper passage and, as a result of this arrangement, the right end portion of the paper remains as it is without being cut. Namely, the range L1 from the right end portion of the fixed blade 24 to the convex piece 21*a* on the right side of the guide 21 is served to leave the paper behind as an uncut portion.

Two projections 2*a* and 2*b* are provided in the guide 21 upstream of the cutting tool and are provided at a position corresponding to the portion having an uncut portion of the paper left behind in the horizontal direction (direction of the width of the paper), as illustrated in FIG. 1, and respectively at the lowest portion and the middle portion of the guide 21 in the vertical direction, as illustrated in FIG. 2. The projection 2*a* at the middle stage is provided on one surface of the guide 21 and the projection 2*b* at the lowest stage 2*b* is provided on the other surface of the guide 21.

Figure 3:
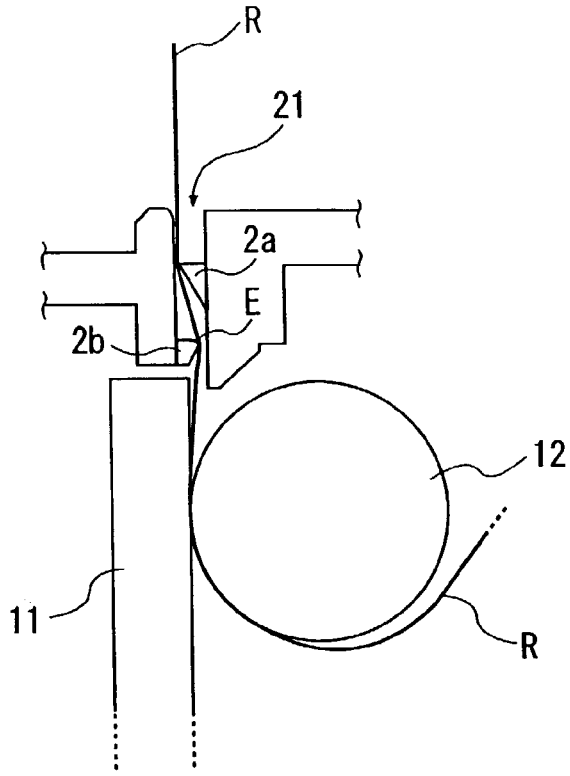
FIG. 3 is a lateral cross section view for use in describing the state where the paper is pulled.

FIG. 3 shows a view from the lateral viewpoint of a state where the paper passing through the guide 21 is pulled from the outside.

In this embodiment, the two projections 2*a* and 2*b* are designed to have an inclination such that a protruding degree can be relatively smaller on the side of the inlet of the guide 21 and relatively larger on the side of the outlet thereof (inclined about 30° to the wall surface of the guide 21) and that the sum of the maximum protruding degrees (widths) c of the guide 21 (a+b>c).

The inclination provided in the two projections 2*a* and 2*b* makes it easy to pass the paper R when the paper R is forwarded from the printing mechanism 10, and as illustrated in FIG. 3, the passage of the paper is bent, according to the above protruding degree, in a shape of S in a state of tightly stretching the paper R.

Further, in the lower projection 2*b*, the edge portion E of the maximum protruding degree is cut off like an arc, so that the contact area of this edge portion E and the paper can become larger in a state of pulling the paper R.

According to the above paper cutter 20, the paper is discharged out with the uncut portion left behind in one portion on the right side of the paper, according to the partial cut of the cutter 20. When the paper is straightly pulled by the uncut portion in a state of being discharged, the tightly stretched paper is bent in shape of an S against the two projections 2*a* and 2*b*, in the lower portion of the uncut portion of the paper, and a frictional drag is generated in the edge portion of these two projections 2*a* and 2*b*.

Namely, the maximum static friction obtained when pulling the paper from the outside is the sum of the static friction f0 in the pressing portion of the platen 12 and the printing head 11 and the static friction (f1+f2) in the edge portions of the two projections 2*a* and 2*b*.

Accordingly, even when the paper is pulled in a state incapable of tearing off the uncut portion easily, since the static friction becomes larger compared with the guide without the projections 2*a* and 2*b*, it becomes easier to tear off the uncut portion of the paper, and therefore, occurrence of a disadvantage of reeling out the paper from the device can be restrained.

Further, when a tensile force F1 capable of straightly pulling and tearing off the uncut portion of the paper is a little beyond the static friction f0 of the pressing portion of the platen 12 and the printing head 11, the total of the static friction can be larger than the tensile force F1 by adding the static friction of the projections 2*a* and 2*b* (f1+f2). Thus, the uncut portion of the paper never fails to be torn off before reeling out the paper.

Figure 4:
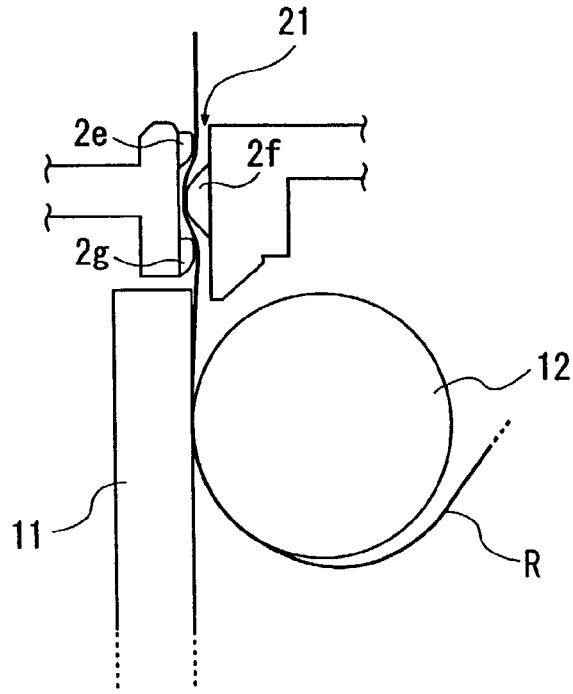
FIG. 4 is a view showing the embodiment of providing three projections as the resistance adding means.

FIG. 4 shows an example of forming three projections in the guide as resistance adding means.

As the resistance adding means, three projections may be provided in the guide 21, as illustrated in FIG. 4. Namely, they are a projection 2*e* provided on one surface of the wall in the upper portion, a projection 2*f* provided on the other surface of the wall in the middle portion, and a projection 2*g* provided on one surface of the wall in the lower portion. These three projections 2*e*, 2*f*, and 2*g* are formed in a shape of having an inclination such that the protruding degree is small on the inlet side of the guide 21 and that the protruding degree becomes larger and larger according to the direction forwarding to the outlet.

When the maximum protruding degrees of the projections 2*e*, 2*f*, and 2*g* are respectively defined as e, f, and g and the width of the interstice between the both walls of the guide 21 is defined as c, the maximum protruding degrees of the three projections 2*e*, 2*f*, and 2*g* are formed in a way of satisfying the relationship (c<e+f) and (c<f+g). Further, the maximum protruding degree of the upper projection 2*e* is formed smaller than the lower projection 2*g* (e<g), so as not to disturb the discharge and the cutting processing of the paper R.

Namely, the lower projection 2*g* and the middle projection 2*f* may be formed to have such a protruding degree as to prevent a paper jam (paper clogging) and obtain a desired friction drag, and the upper projection 2*e* may be formed to have such a protruding degree so as not to cause the paper jam and disturb a cut of the paper. The respective projections 2*e* to 2*g* may be formed in any shape as long as they can obtain a desired friction drag and they do not disturb the passage of the paper.

The invention is not restricted to the above embodiments, but various modifications are possible. For example, the following modification can be considered as the resistance adding means for adding a resistance to the paper when the paper is pulled from the outside.

FIG. 5 is a schematic view of the second embodiment of the resistance adding means.

Figure 5A:
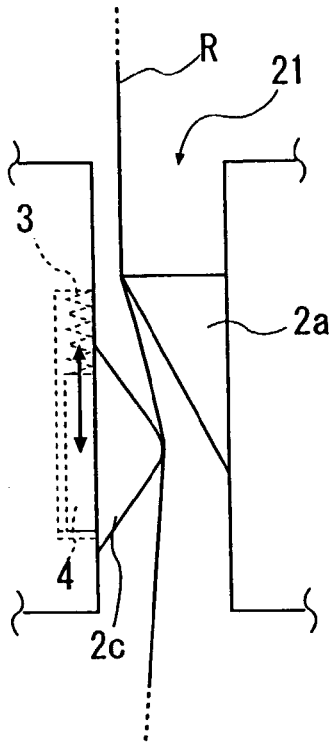
FIGS. 5A and 5B are schematic views showing the third embodiment of the resistance adding means.
Figure 5B:
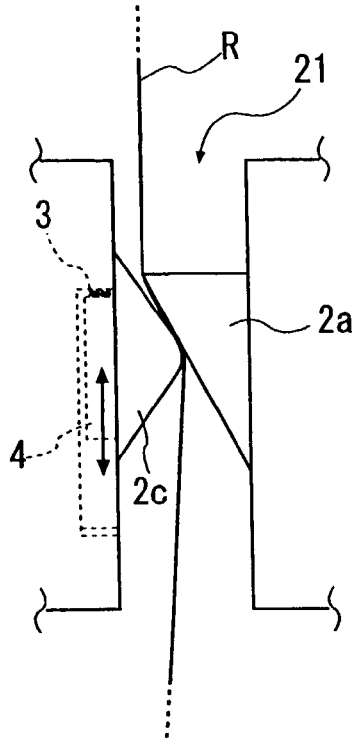

In this embodiment, as the resistance adding means, a movable projection 2*c* installed in a vertically movable state and a fixedly installed projection 2*a* are provided on the side walls of the guide 21. When the paper R is forwarded upwardly according to the rotation of the platen 12, the movable projection 2*c* is positioned at the lower portion by a weak spring force since no strong force works on the paper R, so to pass the paper R through the guide 21 (FIG. 5A). While, when the paper R is strongly pulled from the outside, the paper R comes into close contact with the movable projection 2*c*, and the movable projection 2*c* is moved upward by small deformation of the paper R, so to pinch the paper R with the fixed projection 2*a* (FIG. 5B). Thus, a strong resistance is added to the paper R. A rubber may be attached to the end portion of the movable projection 2*c* so as to increase a friction.

A guide groove 3 may be provided on the side wall of the guide 21 for guiding movement of the movable projection 2*c*, and an engagement portion 4 may be provided on the side portion of the movable projection 2*c* to slidably engage the engagement portion 4 in the guide groove 3 in a vertically movable way. When a printer at use stands like that shown in FIG. 5, since the projection 2*c* falls down by the own weight, no biasing spring is necessary.

Figure 6A:
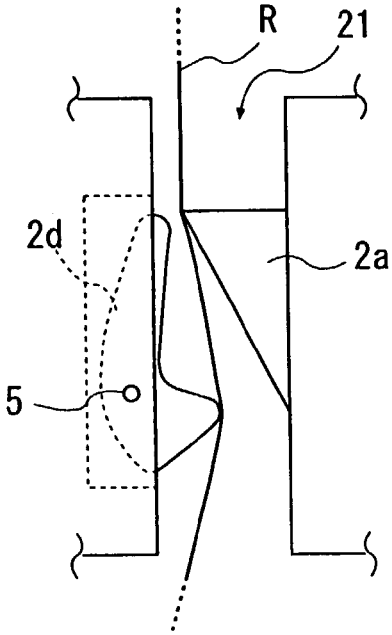
FIG. 6 is a schematic view showing the third embodiment of the resistance adding means.
Figure 6B:
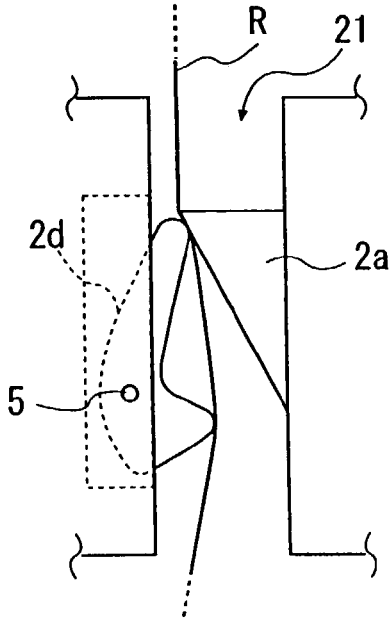

FIG. 6 shows the schematic view of the third embodiment of the resistance adding means.

In this embodiment, as the resistance adding means, a rotary member 2*d* rotatable around a supporting point 5 in an elbowed shape and a fixedly installed projection 2*a* are provided on the side walls of the guide 21. When the paper R is forwarded upwardly according to the rotation of the platen 12, the paper R moves easily through the guide 21 since a strong force is not applied on a lower arm of the rotary member 2*d* (FIG. 6A), while when the paper R is strongly pulled from the outside (FIG. 6B), the paper R pushes a lower arm of the rotary member 2*d* and rotates it until the position of bringing an arm extending upward into contact with the projection 2*a*. Thus, the paper R is pinched between the upper arm of the rotary member 2*d* and the fixed projection 2*a*, thereby adding a strong resistance to the paper R.

Moreover, the resistance adding means may be formed to add a resistance to the paper by pushing the paper by an electric drive from the end of the cutting processing to the beginning of the next printing processing, or even in the case of providing a projection in the guide, the shape and the number of the projections is not restricted to the above-mentioned embodiments, but various modifications are possible.

In the embodiments, although the description has been made by way of example of the paper cutter of the type of cutting the paper by pinching it between the movable blade moving back and forth and the fixed blade, the invention can be adopted to a cutter of any type including a rotary cutter for cutting the paper while moving a rotary blade along the width direction of the paper and the like.

As set forth hereinabove, according to the invention, the resistance adding means adds a resistance to the paper, which makes it easy to tear off the paper, and therefore, it is effective in preventing reeling out of the paper.

Since the resistance adding means is formed by two projections for bending the passage of the continuous paper while making contact with the both surfaces of the continuous paper and these projections are tapered, nothing obstructs the passage of the paper along the guide and the optimum quality can be obtained such that a proper resistance is added to the paper when pulling the paper.

What is claimed is:

1. A paper cutter comprising: a guide through which paper from a source of continuous paper is guided in a forward feeding direction; cutting means for partially cutting the continuous paper that passes through the guide such that a portion of the paper remains uncut; and resistance adding means provided in the guide upstream of the cutting means with respect to the forward feeding direction for adding a resistance to the continuous paper against forward feeding movement thereof in response to a tensile force applied to continuous paper that has already been fed through the guide, the resistance adding means comprising projections extending into the guide for contacting opposite surfaces of the continuous paper to cause it to bend as it passes through the guide so that the tensile force causes the uncut portion to be severed.

2. A paper cutter according to claim 1; wherein at least one of the projections is movably mounted to undergo movement towards another one of the projections in response to a tensile force applied to the paper to increase the resistance added to the paper.

3. A paper cutter according to claim 1; wherein the projections comprise one or more first projections provided near an inlet of the guide and one or more second projections provided near an outlet of the guide, the one or more second projections extending further into the guide than the one or more first projections.

4. A paper cutter according to claim 1; wherein the projections are provided near the uncut portion of the continuous paper.

5. A paper cutter according to claim 1; wherein the source of continuous paper comprises a roll of paper.

6. A paper cutter according to claim 1; wherein the resistance adding means is located near the uncut portion of the continuous paper.

7. A paper cutter comprising: a guide through which paper from a source of continuous paper is guided in a forward feeding direction; cutting means for partially cutting the continuous paper that passes through the guide such that a portion of the paper remains uncut; and resistance adding means provided in the guide upstream of the cutting means with respect to the forward feeding direction for adding a resistance to the continuous paper against forward feeding movement thereof in response to a tensile force applied to continuous paper that has already been fed through the guide, the resistance adding means comprising a plurality of projections that come in contact with opposite surfaces of the continuous paper to bend the continuous paper as it passes through the guide.

8. A paper cutter according to claim 7; wherein the plurality of projections comprise two or more first projections that come into contact with one surface of the continuous paper as it passes through the guide and one or more second projections that come into contact with an opposite surface of the continuous paper as it passes through the guide to add a resistance to the continuous paper when a tensile force is applied thereto to cause the uncut portion to be torn.

9. A thermal printer comprising: a printing head having a plurality of heating elements for printing dots onto a continuous paper; a platen for urging the continuous paper against the printing head and for feeding the continuous paper relative to the printing head; and a paper cutter according to any one of claims 1, 2, 3, 4, 7, or 8; wherein the guide is positioned near an output of the printing head.

10. A paper cutter comprising: a guide through which paper from a source of continuous paper is guided in a forward feeding direction; a cutting tool for partially cutting the continuous paper that passes through the guide such that one portion of the paper remains uncut; and at least two projections extending into the guide for contacting opposite surfaces of the continuous paper to impart a resistance against forward feeding movement to the continuous paper in response to a tensile force applied to continuous paper that has already been fed through the guide so that the uncut portion of the continuous paper becomes torn in response to the applied tensile force without causing forward feeding movement or skewing of continuous paper that has not yet passed through the guide.

11. A paper cutter according to claim 10; wherein the at least two projections are disposed upstream of the cutting tool with respect to the forward feeding direction.

12. A paper cutter according to claim 10; wherein at least one of the projections is movably mounted to undergo movement towards another one of the projections in response to a tensile force applied to the paper to increase the resistance added to the paper.

13. A paper cutter according to claim 10; wherein the at least two projections comprise one or more first projections provided near an inlet of the guide and one or more second projections provided near an outlet of the guide, the one or more second projections extending further into the guide than the one or more first projections.

14. A paper cutter according to claim 10; wherein the at least one projection is provided near the uncut portion of the continuous paper.

* * * * *